United States Patent [19]

Sternberg

[11] Patent Number: 4,847,628

[45] Date of Patent: Jul. 11, 1989

[54] FREQUENCY INDEPENDENT CONSTANT BEAMWIDTH DIRECTIONAL LENS ANTENNA FOR VERY WIDEBAND AND MULTI-CHANNEL ELECTROMAGNETIC COMMUNICATIONS

[75] Inventor: Robert L. Sternberg, Noank, Conn.

[73] Assignee: The United States of America as represented by the Secretary of the Navy

[21] Appl. No.: 216,056

[22] Filed: Jul. 7, 1988

[51] Int. Cl.[4] ..... H01Q 15/08

[52] U.S. Cl. ..... 343/754; 343/911 R

[58] Field of Search ..... 343/753, 754, 909, 911 R, 343/755

[56] References Cited

U.S. PATENT DOCUMENTS 3,787,872 1/1974 Kauffman ..... 343/911 R
4,224,626 9/1980 Sternberg ..... 343/911 R
4,553,629 11/1985 Sternberg ..... 343/911 R
4,591,864 5/1986 Sternberg et al. ..... 343/754
4,721,966 1/1988 McGrath ..... 343/754

*Primary Examiner*—Rolf Hille
*Assistant Examiner*—Doris J. Johnson
*Attorney, Agent, or Firm*—Arthur A. McGill; Prithvi C. Lall; Michael J. McGowan

[57] ABSTRACT

A frequency independent constant beamwidth lens antenna concept is described utilizing a point source to point focus nonspherical lens. The essential feature is that a twisted planar or hyperbolic paraboloidal phase or wave front is formed by the antenna which then in turn produces a frequency indepenent constant beamwidth beam in the far field of the antenna for radiation or reception of planar or nearly planar spherical waves. Moreover, the frequency independent constant beamwidth beam may be steered or scanned in azimuth without moving the lens antenna or a plurality of fixed beams in different directions may be formed simultaneously by the lens antenna.

13 Claims, 1 Drawing Sheet

FREQUENCY INDEPENDENT CONSTANT BEAMWIDTH DIRECTIONAL LENS ANTENNA FOR VERY WIDEBAND AND MULTI-CHANNEL ELECTROMAGNETIC COMMUNICATIONS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to means of forming one or more scannable or fixed direction constant beamwidth beams via a twisted wave front in the near field of an antenna or a single directive scannable beam for radiation or reception of plane or spherical waves which are nearly plane in the far field of the antenna. The beams or beam are substantially frequency independent and have substantially constant beamwidths independent of the frequency used. The beams or beam are formed using an electromagnetic lens and one or more point sources or receivers. They are for electromagnetic applications where multi-channel or very wide band capability is needed in combination with high gain and narrow constant beam width directionality.

(2) Description of the Prior Art

Previous systems for achieving the same results include a first system using various phased array or spherical array processing and beam forming methods. A second system described by Sternberg et al. in U.S. Pat. No. 4,591,864 had cylindrical lenses with line source receiving or radiating elements set at a slight angle to the reference axis or generators of the cylindrical lens surfaces. The invention was described for acoustic systems but also stated its use in the electromagnetic area.

The first system requires extensive data processing and/or electronics to control and scan the beams formed. The second system requires use of line sources or line receiver elements and cannot be done with point sources or point receivers.

SUMMARY OF THE INVENTION

This system provides a hyperbolic paraboloidal wave front from a point source or point focus nonspherical lens that forms a plurality of fan beams in a direction orthogonal to the wave front. The plurality of fan beams form a composite beam that is of a substantially constant beam width regardless of frequency. The wave front is formed by a lens and source having particular geometries. Depending on the system chosen, the composite beam may be fixed in space or scanned, or multiple simultaneous composite beams in a plurality of directions may be formed using a plurality of point sources or point receivers distributed over the focal surface of the lens antenna. The system has particular application in the electromagnetic communications field wherein it is desirable to provide a directional antenna with a scannable beam or a plurality of beams in different directions, each of which is frequency independent with constant beamwidth for radiation or reception of plane or spherical waves which are nearly plane in the far field of the antenna.

DESCRIPTION OF THE PREFERRED EMBODIMENT

As a basic concept it is to be noted first as in Sternberg et al. in U.S. Pat. No. 4,591,864 that if a twisted planar or, what is the same thing, if a hyperbolic paraboloidal phase or wave front W can be created in the immediate near field of the antenna and propagating in the positive z direction and having the form $z=kxy$ where k is a constant which is small compared to the largest value of x or y used, i.e., k is small compared to the largest diameter of the lens forming the wave front W described above, then over frequency bands for which the wavelength is also small compared to the largest x or y used it will result that in the far field of the antenna, over areas restricted to the width of the beam, the beam in the z direction will radiate or receive effectively planar, or spherical but nearly planar, waves and have substantially constant beamwidths in both the x,z plane and the y,z planes. Further, the beam formed will have a substantially constant beam shape in general.

Figure 1:
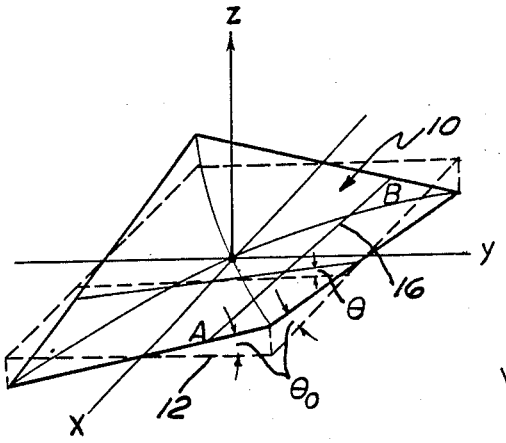
FIG. 1 shows a representation of a twisted planar wave front formed in accordance with the present invention.
Figure 2:
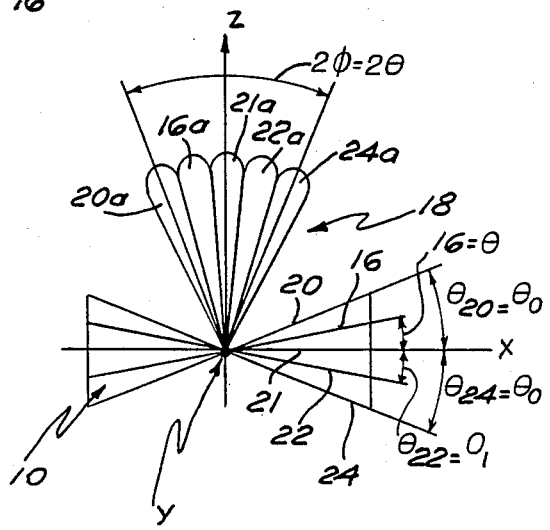
FIG. 2 shows a view of a plurality of fan beams formed from the twisted planar wave front of FIG. 1.

To see this in FIG. 1 there is shown a twisted planar, or what is the same thing, a hyperbolic paraboloidal wave front 10. The wave front 10 is shown with rotated Cartesian coordinates x,y,z. The location of the wave front 10 can be realized by relating the wave front 10 to a portion of the x,y plane 12 that is shown with dashed lines. The wave front 10 propagates in the positive z direction and has the equation $$z=kxy \qquad \text{(Eq. 1)}$$

wherein k is a constant and is small compared to the largest value of x or y used. This makes the constant k small compared to the largest diameter of the lens (not shown in FIG. 1) forming the wave front 10. In frequency bands for which the wavelength is also small compared to the largest x or y used, the beam radiating in the z direction will have approximately constant beamwidths in both the x,z plane and the y,z plane. To see this it is only necessary to note that each narrow strip on the twisted planar or hyperbolic paraboloidal phase or wave front 10, bordering each line on 10, of the form $y=\text{constant}$, $z=kxy$ such as the line AB 16 in FIG. 1, forms a fan beam 16*a* as shown in FIG. 2. Each such fan beam 16*a*, 20*a*, 21*a*, 22*a* and 24*a* is fanned widely in directions perpendicular to the corresponding strip and has a half-power or 3 dB beam width in the x,z plane given approximately in degrees by the formula:

$$beamwidth \simeq 65\ \lambda/\overline{AB} \qquad \text{(Eq. 2)}$$

wherein $\overline{AB}$ denotes the length of line AB 16. Each line of the form, $y=\text{constant}$, $z=kxy$ such as line AB 16 is at a different angle $\Theta$ to the x,y plane than the other lines of the same form. This is shown in FIG. 2 with lines 16, 20, 21, 22 and 24. Each of the lines 16, 20, 21, 22 and 24 is at a different angle Θ to the x,y plane. The tangent of the angle Θ in FIG. 1 is proportional to the distance x of the line AB from the x,z plane and is given by the formula:

$$\tan \Theta = z/y = kx. \quad \text{(Eq. 3)}$$

wherein k is a constant. It follows that each such fan beam 16*a*, 20*a*, 21*a*, 22*a* and 24*a* formed from each such strip associated with respective lines 16, 20, 21, 22 and 24 is pointed in a slightly different direction relative to the y,z plane. Collectively, the fan beams 16*a*, 20*a*, 21*a*, 22*a*, and 24*a* form the composite beam 18, of FIG. 2. Thus the strip centered on the x-axis, i.e., at a distance y=0 from the x,z plane and at an angle Θ=0 to the x-axis radiates a fan beam centered about the z-axis and fanned widely in the y,z plane with half power width in the x,z plane again given approximately in degrees by the formula of (Eq. 2).

Taken together, the collection of all of the fan beams forms a single beam of half power width in the x,z plane equal approximately to 2ϕ wherein $2\phi = 2\Theta_o$. The angle $2\Theta_o$ is the total angle of twist of the wave front as indicated in FIGS. 1 and 2. To find the exact half-power beam width in the x,z plane, it is to be noted from FIG. 2 that the 2ϕ dimension does not include the outer halves of the left most and right most fan beams. Therefore, the half-power beam width in the x,z plane is actually equal to 2ϕ plus one individual beam width as recited in the following equations:

$$BW^* = 2\phi + 65\ \lambda/\overline{AB} \quad \text{(Eq. 4)}$$

or $$BW^* = 2\Theta_o + 65\ \lambda/\overline{AB} \quad \text{(Eq. 5)}$$

wherein BW* is the beam width in degrees of the composite beam made up of all the individual fan beams. This beam width BW* is substantially, but not exactly, constant with changes in frequency. It can be seen from either (Eq. 4) or (Eq. 5) that the beamwidth becomes constant as the frequency tends toward infinity causing λ to approach zero. In practical applications the beamwidth is approximately but not exactly constant. The approximation to constancy improves as the frequency gets higher causing λ to get smaller. Moreover, although the individual beams from the individual strips were fan beams fanned in the y,z plane, it is clear by symmetry that the composite beam formed by the collection of fan beams described above has the same finite and approximately constant beam width in the y,z plane. The edges of the individual fan beams cancel each other out.

The width of each narrow strip on the twisted planar or hyperbolic paraboloidal phase or wave front 10 in FIGS. 1 and 2 bordering each line such as 16 can be thought of as being arbitrarily narrow. It follows that the number of fan beams filling out the sector of center-to-center angular width $2\phi = 2\Theta_o$ in FIG. 2 can be thought of as being equally arbitrarily large in number. Regardless of the frequency, as long as wavelength λ is small compared to the largest allowable values of x and y, or compared to the diameter of the lens forming the wave front 10, the sector $2\phi = 2\Theta_o$ will be completely filled out by the fan beams.

Figure 3:
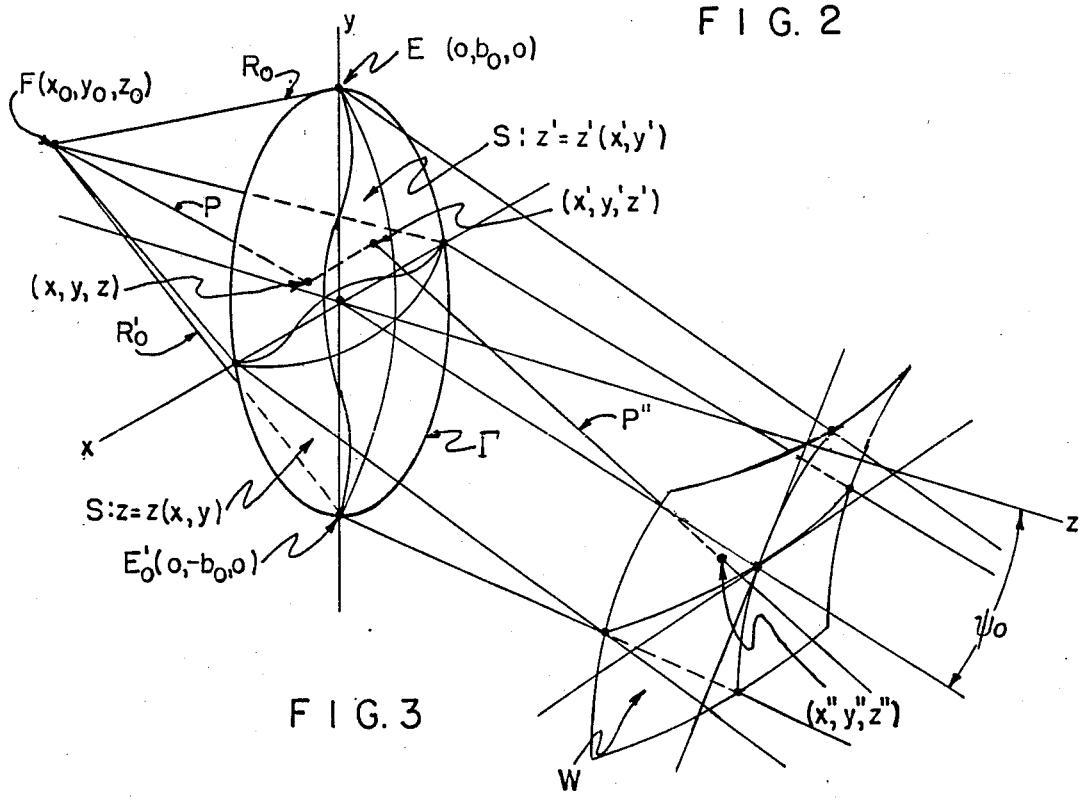
FIG. 3 shows a twisted planar or hyperbolic paraboloidal phase front or wave front formed by a point source or point receiver electromagnetic lens antenna in accordance with the present invention.

For a preferred embodiment refer now to FIG. 3 to note that such a twisted planar or hyperbolic paraboloidal phase front or wave front 10 in FIG. 1 or W in FIG. 3 can also be formed by a nonspherical lens and a point source or point receiver at its point focus instead of by the method described in Sternberg et al. U.S. Pat. No. 4,591,864. Mathematically, the problem of determining the shape of the surfaces S: $z=z(x,y)$ and S': $z'=z'(x',y')=z'[x'(x,y),y'(x,y)]$ for this new lens is governed by solution of a non-linear system of six partial differential equations subject to certain functional symmetry conditions and related extremizing boundary conditions.

The system to be solved for the unknown function $z=z(x,y)$ and $z'=z'(x',y')$ which define the surfaces S and S' of the lens is of the form:

$$\frac{\partial z}{\partial x} = F(A),\ \frac{\partial(z',y')}{\partial(x,y)} = F'(A)\frac{\partial(x',y')}{\partial(x,y)} \quad \text{(Eq. 6)}$$

$$\frac{\partial z}{\partial y} = G(A),\ \frac{\partial(x',z')}{\partial(x,y)} = G'(A)\frac{\partial(x',y')}{\partial(x,y)} \quad \text{(Eq. 7)}$$

$$(z''-z')\frac{\partial w}{\partial x''} + (x''-x') = 0 \quad \text{(Eq. 8)}$$

$$(z''-z')\frac{\partial w}{\partial y''} + (y''-y') = 0 \quad \text{(Eq. 9)}$$

for given $z''=w(x'',y'')$, and given F(A), F'(A), G(A) and G'(A) where A denotes the set of variables:

$$A \equiv (x,y,z,\ x',y',z',\ x'',y'',z'',)$$

and where $z''=w(x'',y'')$ is the equation of the hyperbolic paraboloidal phase front W, and where the functions z(x,y) and z'(x',y') must also satisfy symmetry conditions of the form $$z(-x,y) = z(x,-y) = z(x,y) \quad \text{(Eq. 10)}$$

and $$z'(-x',y') = z'(x',-y') = z'(x',y') \quad \text{(Eq. 11)}$$

where $x'=x'(x,y)$ *and* $y'=y'(x,y)$, and where the functions z(x,y) and z'(x',y') must also satisfy boundary conditions of the form $$z(0,\pm b_o) = z'(0,\pm b_o) = 0 \quad \text{(Eq. 12)}$$

and $$z(x,y) = z'(x,y) = 0 \quad \text{(Eq. 13)}$$

on an ellipse of the form $$\Gamma: (x^2/b_o^2\cos^2{}_o) + y^2/b_o^2 = 1,\ z=0 \quad \text{(Eq. 14)}$$

A typical analytic solution for S: $z=z(x,y)$ and S': $z'=z'(x',y')$ by series and polynomial approximations can be cast in the form $$S: z = \lim_{N\to\infty} \sum_{n=0}^{2N+1} \beta_n(N)\,[(x^2/\cos^2\psi_o) + y^2]^n + \sum_{m,\,n=1}^{\infty} \gamma_{mn} x^{2m}[(x^2/\cos^2\psi_o) + y^2 - b_o^2]^n \quad \text{(Eq. 15)}$$

and $$S': z' = \lim_{N\to\infty} \sum_{n=0}^{2n+1} \beta'_n(N)\,[(x'^2/\cos^2\psi_o) + y'^2]^n + \quad \text{(Eq. 16)}$$

-continued $$\sum_{m,\,n=1}^{\infty} \gamma'_{mn} x'^{2m}[(x'^2/\cos^2\psi_o) + y'^2 - b_o^2]^n. \quad \text{(Eq. 16)}$$

The coefficients are then computed by various Cauchy-kovalevsky and pseudo eigenvalue like approaches as used in related plane wave scanning lens antenna problems such as described by the present inventor in U.S. Pat. No. 4,224,626.

The principal advantage of the new method of forming substantially frequency independent, constant beam width fixed or scannable beams is the elimination of the need for elaborate phase and controlling electronics in the case of phased or spherical arrays and the ability to form the beams with a nonspherical lens and a point source or point receiver at a point focus rather than having to use line sources or line receivers as was done in the prior art.

From a geometrical optics point of view the lens produces a phase or wave front of a type not previously produced or desired from a lens having one or more point foci at which the point sources or point receivers are located.

Various alternative ways of shaping the lens to produce the same effect either from one or more line or point sources, may suggest themselves to those skilled in the art, although the lens may then become heavier and thicker then necessary and the mathematics involved in the design may become more complicated. Materials of construction in any case may be any standard materials used for fabrication of electro-magnetic lenses such as solid polystyrene or plexiglass or foamed polystyrene loaded with aluminum oxides, or other materials to provide the desired index of refraction in the electromagnetic bands being used.

It will be understood that various changes in details, materials, steps and arrangement of parts, which have been herein described and illustrated in order to explain the nature of the invention, may be made by those skilled in the art within the principle and scope of the invention as expressed in the appended claims.

What is claimed is:

1. A frequency independent constant beam width point source and point focus nonspherical directional lens antenna for very wideband and multi-channel communications with the shape of the surfaces S and S' defined by equations of the form: S: $z=z(x,y)$ and S': $z'=z'(x',y')=z'[x'(x,y),y'(x,y)]$ such that the functions $z=z(x,y)$ and $z'(x',y')$ satisfy the nonlinear system of partial differential equations $$\frac{\partial z}{\partial x} = F(A), \frac{\partial(z',y')}{\partial(x,y)} = F'(A)\frac{\partial(x',y')}{\partial(x,y)}$$

$$\frac{\partial z}{\partial y} = G(A), \frac{\partial(x',z')}{\partial(x,y)} = G'(A)\frac{\partial(x',y')}{\partial(x,y)}$$

$$(z'' - z')\frac{\partial w}{\partial w''} + (x'' - x') = 0$$

$$(z'' - z')\frac{\partial w}{\partial y''} + (y'' - y') = 0$$

for given $z''=w(x'',y'')$, and given F(A), F'(A), G(A) and G'(A) where A denotes the set of variables: $A\equiv(x,y,z,\ x',y',z',\ x'',y'',z'')$ and where $z''=w(x'',y'')$ is the equation of a hyperbolic paraboloidal phase front W and the functions $z=z(x,y)$ and $z'=z'(x',y')$ also satisfy symmetry conditions of the form $$z(-x,y)=z(x,-y)=z(x,y)$$

and $$z'(-x',y')=z'(x',-y')=z'(x',y')$$

where $x'=x'(x,y)$ and $y'=y'(x,y)$ and where the functions $z=z(x,y,)$ and $z'=z'(x',y')$ also satisfy boundary conditions of the forms $$z(0,\pm b_o)=z'(0,\pm b_o)=0$$

and $$z(x,y)=z'(x,y)=0$$

on an ellipse of the form $\Gamma$: $(x^2/b_o^2\cos^2\psi_o)+y^2/b_o^2=1$, $z=0$.

2. A frequency independent constant beam width point source and point focus nonspherical directional lens antenna according to claim 1 wherein said lens antenna is an electromagnetic lens antenna.

3. A frequency independent constant beam width point source and point focus nonspherical directional lens antenna according to claim 2 wherein said lens antenna is made of solid polystyrene.

4. A frequency independent constant beam width point source and point focus nonspherical directional lens antenna according to claim 2 wherein said lens antenna is made of plexiglass.

5. A frequency independent constant beam width point source and point focus nonspherical directional lens antenna according to claim 2 wherein said lens antenna is made of foamed polystyrene loaded with aluminum oxides.

6. A frequency independent constant beamwidth point source and point focus nonspherical directional lens antenna according to claim 1 wherein said lens antenna is a multibeam electromagnetic lens antenna.

7. A frequency independent constant beamwidth point source and point focus nonspherical directional lens antenna according to claim 6 wherein said lens antenna is made of solid polystyrene.

8. A frequency independent constant beamwidth point source and point focus nonspherical directional lens antenna according to claim 6 wherein said lens antenna is made of plexiglass.

9. A frequency independent constant beamwidth point source and point focus nonspherical directional lens antenna according to claim 6 wherein said lens antenna is made of foamed polystyrene loaded with aluminum oxides.

10. A frequency independent constant beam width point source and point focus nonspherical directional lens antenna according to claim 1 wherein said lens antenna is a scannable electromagnetic lens antenna.

11. A frequency independent constant beam width point source and point focus nonspherical directional lens antenna according to claim 10 wherein said lens antenna is made of solid polystyrene.

12. A frequency independent constant beam width point source and point focus nonspherical directional lens antenna according to claim 10 wherein said lens antenna is made of plexiglass.

13. A frequency independent constant beam width point source and point focus nonspherical directional lens antenna according to claim 10 wherein said lens antenna is made of foamed polystyrene loaded with aluminum oxides.

* * * * *